US008419217B2

(12) United States Patent
Lu et al.

(10) Patent No.: US 8,419,217 B2
(45) Date of Patent: Apr. 16, 2013

(54) LED LAMP

(75) Inventors: Chun-Hung Lu, Taipei (TW); Hong-Jyun Wang, Taipei (TW); Chia-Te Lin, Taipei (TW)

(73) Assignee: Hergy Lighting Technology Corp., Taipei (TW)

( * ) Notice: Subject to any disclaimer, the term of this patent is extended or adjusted under 35 U.S.C. 154(b) by 257 days.

(21) Appl. No.: 13/011,591

(22) Filed: Jan. 21, 2011

(65) Prior Publication Data

US 2012/0188766 A1 Jul. 26, 2012

(51) Int. Cl.
*F21S 4/00* (2006.01)
*F21V 21/00* (2006.01)

(52) U.S. Cl.
USPC ..... 362/249.02; 362/382

(58) Field of Classification Search ..... 362/249.02, 362/382, 249.01, 800, 267, 294; 313/45
See application file for complete search history.

(56) References Cited

U.S. PATENT DOCUMENTS

| | | | | |
|---|---|---|---|---|
| 7,963,672 | B2 * | 6/2011 | Liu et al. | 362/249.02 |
| 2005/0168996 | A1 * | 8/2005 | Koegler et al. | 362/341 |
| 2009/0262532 | A1 * | 10/2009 | Wilcox et al. | 362/248 |

* cited by examiner

*Primary Examiner* — Mariceli Santiago
*Assistant Examiner* — Glenn Zimmerman
(74) *Attorney, Agent, or Firm* — Chun-Ming Shih; HDLS IPR Services

(57) ABSTRACT

The LED lamp includes a heat dissipating base, an LED module, a hood and a sealant. The heat dissipating base has a mount board including a first surface and a second surface. The first and second surfaces are provided with an annular trough and fins, respectively. The LED module is fixed on the mount board and surrounded by the annular trough. The hood is formed with a flange which is embedded into the annular trough to cloak the LED module. The sealant is filled in the annular trough to seal up.

6 Claims, 10 Drawing Sheets

LED LAMP

BACKGROUND OF THE INVENTION

1. Technical Field

The invention relates to lamps, particularly to LED lamps with water resistance.

2. Related Art

Light Emitting diodes (LEDs) have been applied in various kinds of lamps because of features of low energy consumption, power saving, long durability, small volume and fast respondence. However, temperature variation will affect durability and performance of the LEDs. When an LED lamp is designed for outdoor use, the ability of water resistance must be further considered. Thus the heat dissipation and water resistance must be balancedly manipulated in the structural design.

Usually, a conventional LED lamp includes a base, an LED module fixed in the base and a hood mounted on the base and covering the LED module. The hood can be permeated through by the lights from the LED module.

However, this structure cannot provide sufficient heat dissipation ability for modern high power LEDs. And it also lacks water resistance ability required by outdoor lamps.

SUMMARY OF THE INVENTION

An object of the Invention is to provide an LED lamp, which can provide great heat dissipation effect and water resistance ability.

To accomplish the above object, the LED lamp of the invention includes a heat dissipating base, an LED module, a hood and a sealant. The heat dissipating base has a mount board including a first surface and a second surface. The first and second surfaces are provided with an annular trough and fins, respectively. The LED module is fixed on the mount board and surrounded by the annular trough. The hood is formed with a flange which is embedded into the annular trough to cloak the LED module. The sealant is filled in the annular trough to seal up.

In this invention, the fins and base are formed integratedly so as to have lower thermal resistance and to enhance heat dissipation efficiency. By the annularly planar connection between the flange and hood, the water resistance effect can be obtained. And the sealant may further enhance the water resistance effect.

DETAILED DESCRIPTION OF THE INVENTION

Figure 1:
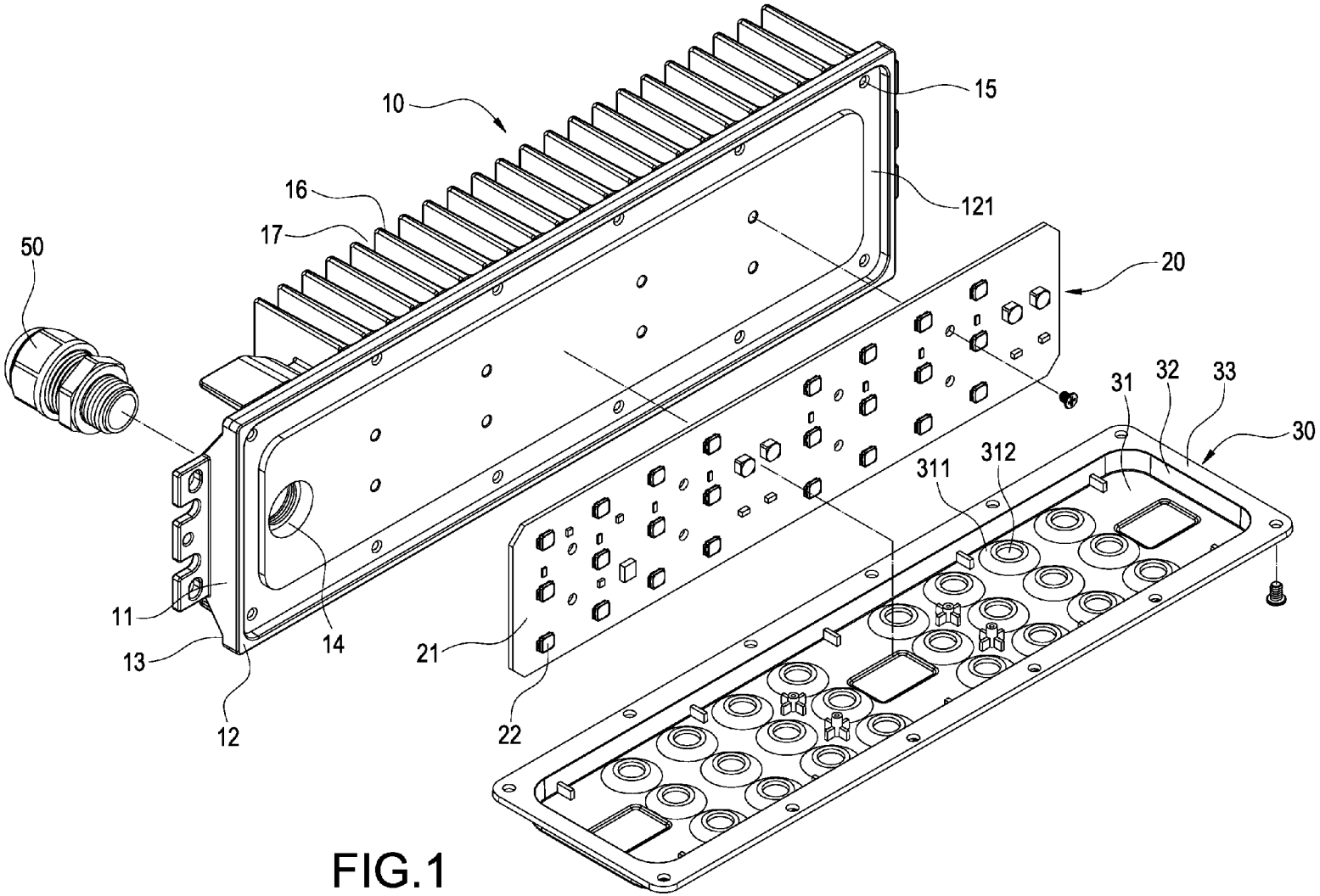
FIG. 1 is an exploded view of the invention.
Figure 2:
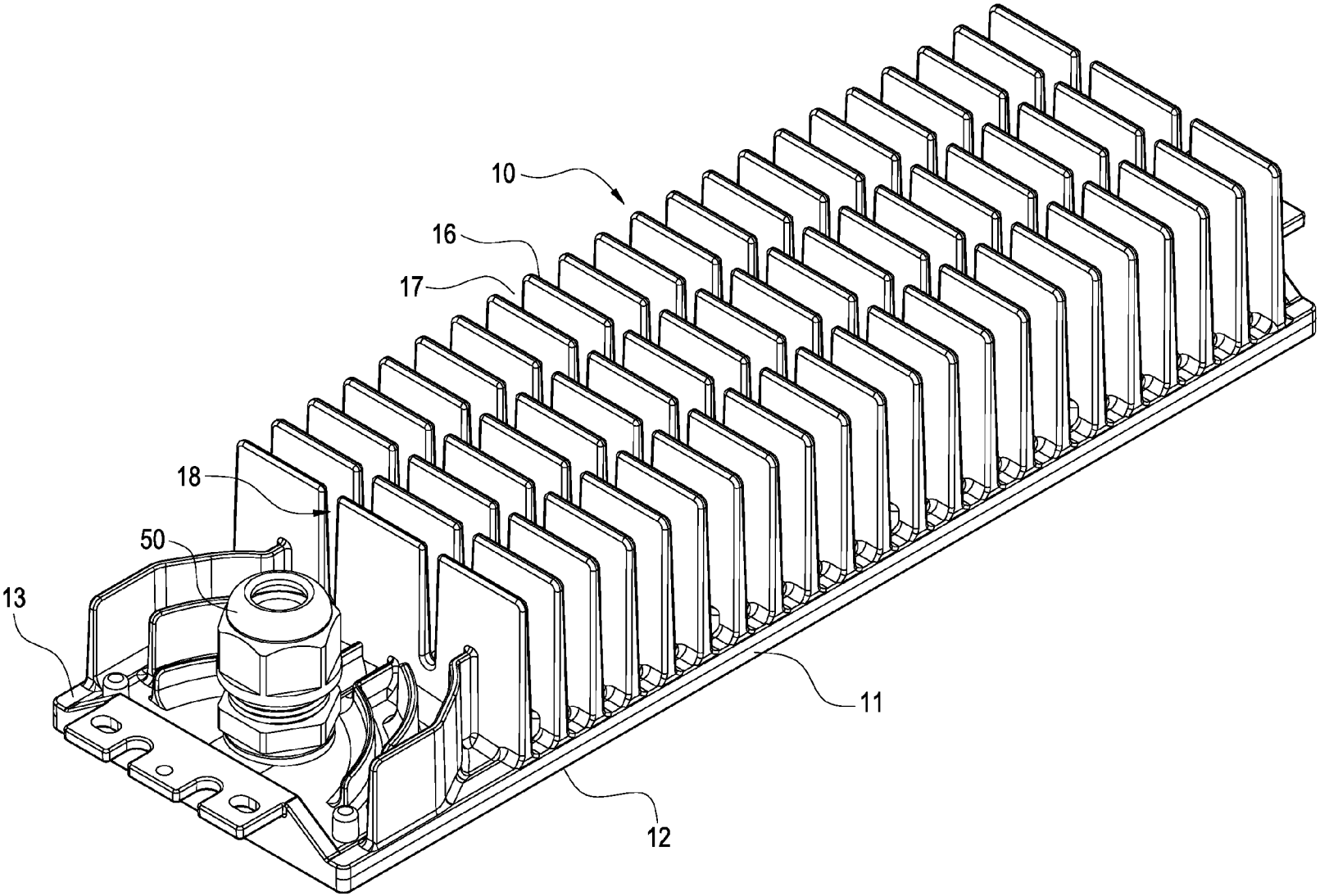
FIG. 2 is an assembled view of the invention.

Please refer to FIGS. 1-4. The LED lamp of the invention includes a heat dissipating base 10, an LED module 20, a hood 30 and a sealant 40.

The heat dissipating base 10 is made of metal with great thermo-conductivity, such as aluminum or aluminum alloy. The heat dissipating base 11 has a mount board 11 which is rectangular in shape and has a first surface 12 and a second surface 13 opposite thereto. An annular trough 121 is formed around the first surface 12. In this embodiment, the annular trough is rectangular in shape. The mount board 11 is provided with a through hole 14 in the annular trough 121. There are plural screwed holes 15 for being fastened by screws. The second surface 13 is formed with a plurality of parallel fins 16 and an air passage 17 is formed between every two adjacent fins 16. Also, a spacing gap 18 is remained between every two adjacent rows of fins 16. The spacing gaps 18 communicate with the air passages 17 to form lateral air convection between two air passages 17.

The LED module 20 includes a circuit board 21 and LEDs 22 mounted on the circuit board 21. The circuit board 21 is fixed on the first surface 12 of the mount board 11 by fastening screws into the screwed holes 15. The LEDs 22 abut against the mount board 11 with a thermal contact. And the LED module 20 is surrounded by the annular trough 121.

Figure 3:
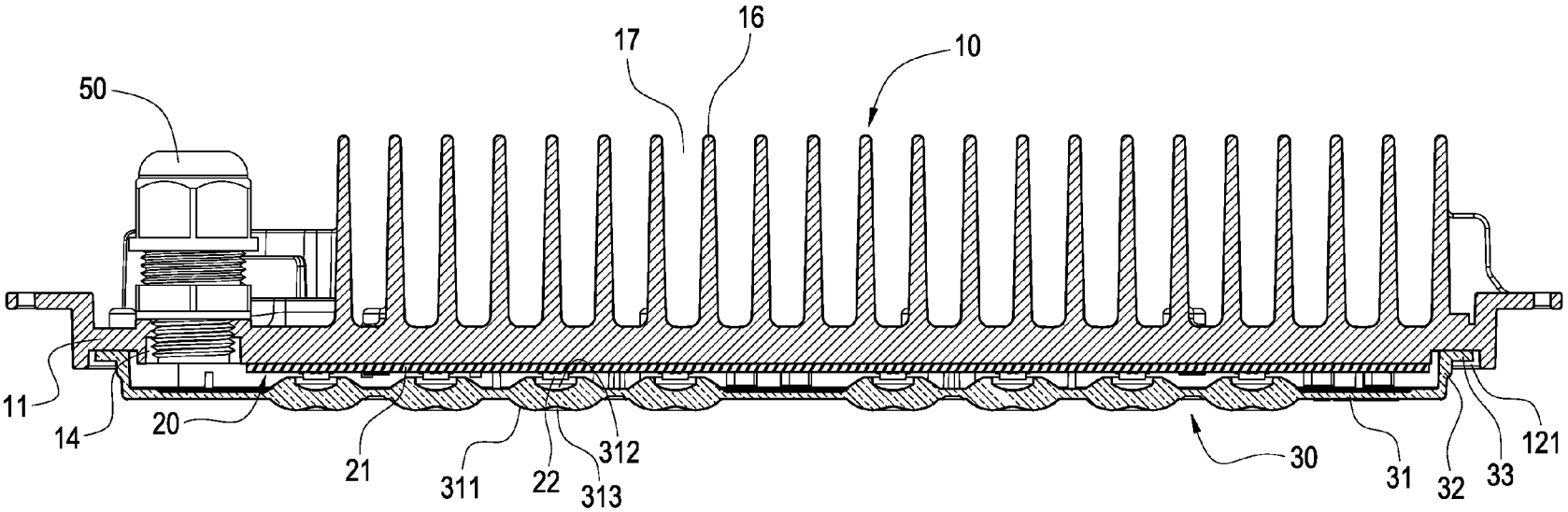
FIG. 3 is a cross-sectional view of the invention.
Figure 4:
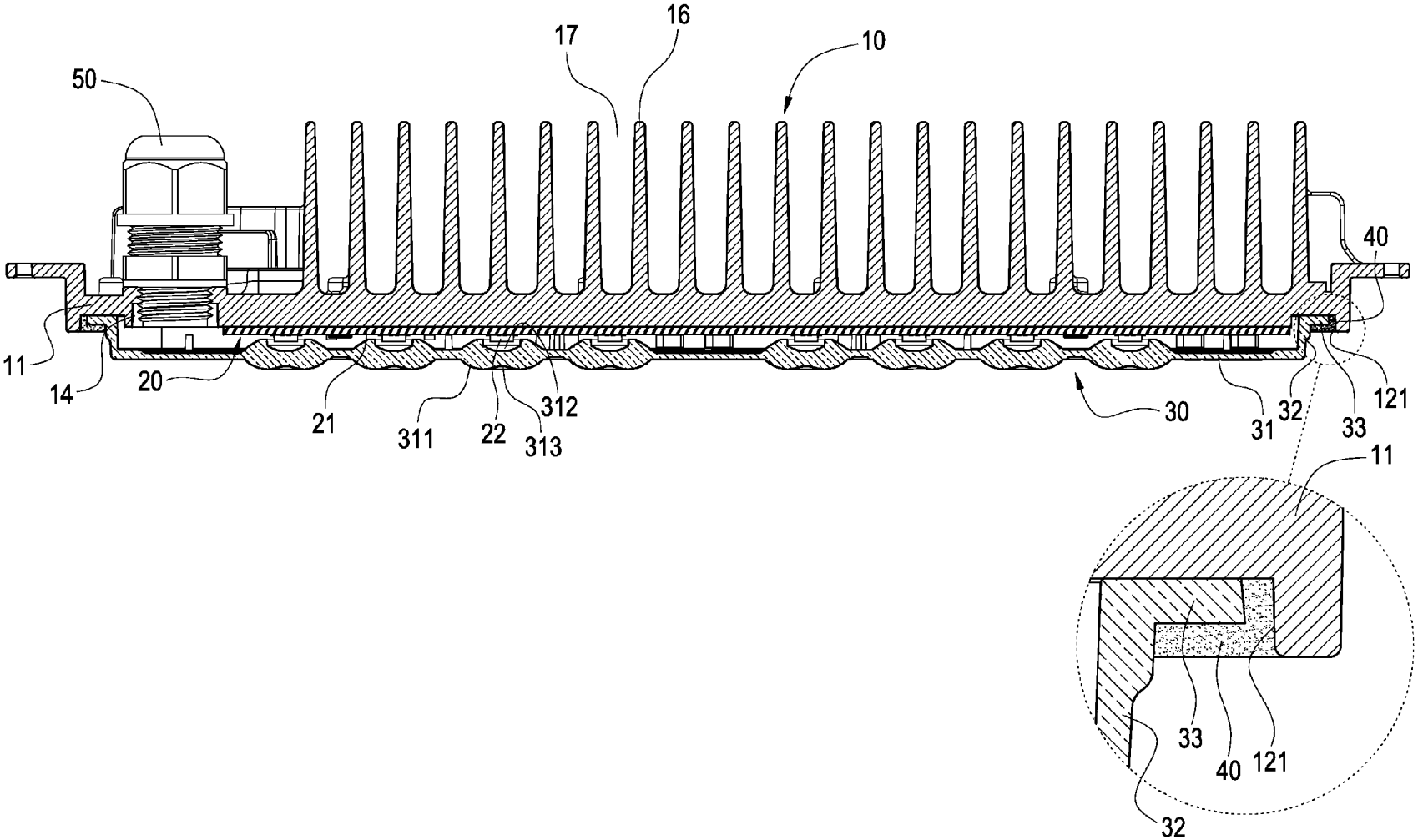
FIG. 4 is a cross-sectional view of the invention with sealant.

The hood 30 is made of transparent or translucent material such as plastic or glass. The hood 30 is provided with a bottom 31, a surrounding wall 32 extending from the bottom 31 and a flange 33 outwards extending from the surrounding wall 32. The hood 30 cloaks the LED module 20 by embedding the flange 33 into the annular trough 121. A plurality of protrusions 311 are formed on the inner side of the bottom 31, which are corresponding to the LEDs 22. As shown in FIG. 3, each of the protrusions 311 is like a button in shape with an upper recess 312 and a lower recess 313. The upper recess 312 accommodates the LED 22 and the lower recess 313 makes the protrusion 311 function as a concave lens. Besides, the flange 33 is further provided with via holes corresponding to the screwed holes 15 for being fastened by screws.

Figure 5:
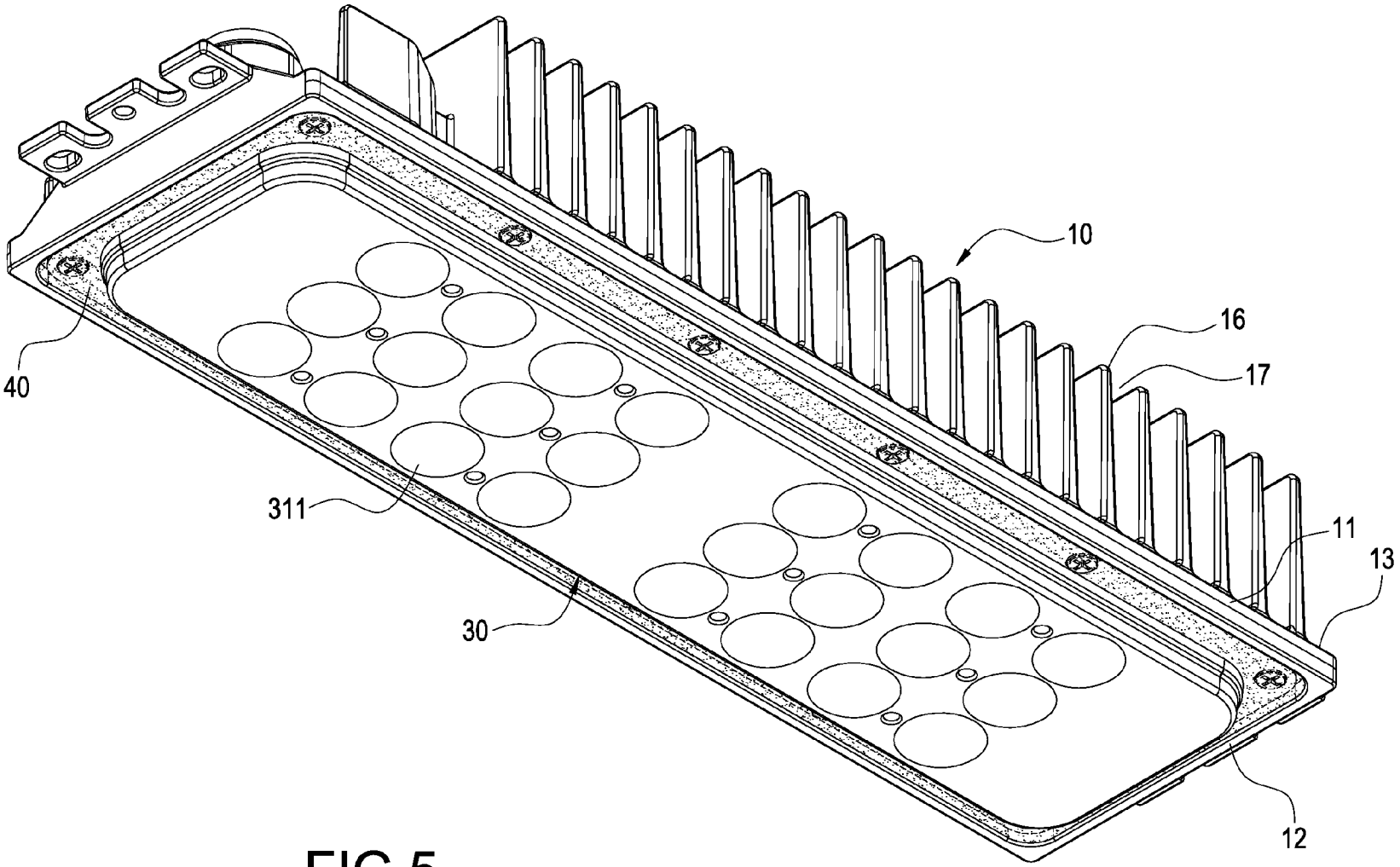
FIG. 5 is an assembled view of the invention in another view angle.

The sealant 40 may be silicone and is filled in the annular trough 121 to seal up after the flange 33 have been fastened by screws as shown in FIG. 5.

Additionally, the LED lamp of the invention further includes a water resistance connector 50 screwed in the through hole 14 for preventing humidity or dusts from permeating the LED lamp.

Figure 6:
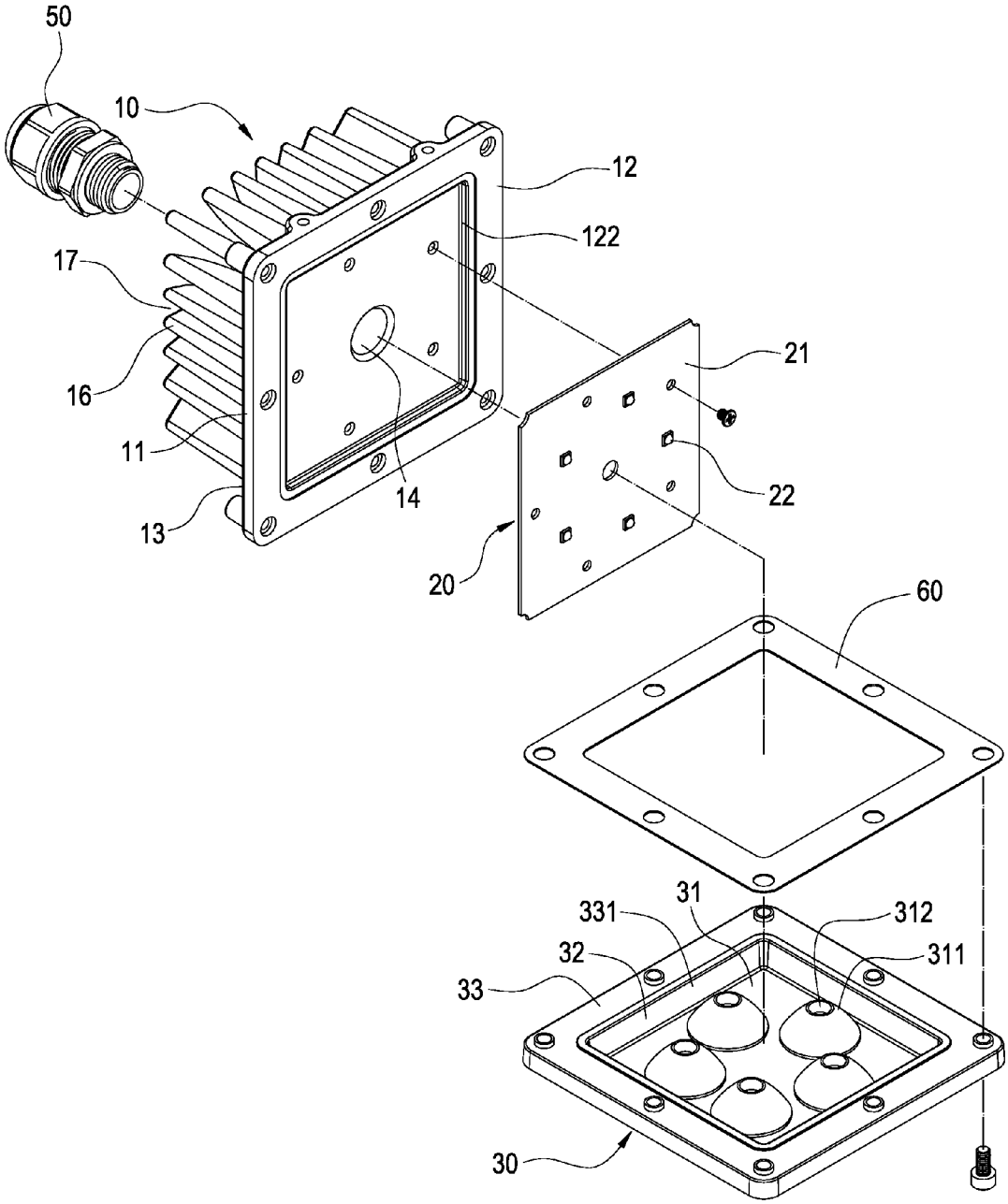
FIG. 6 is an exploded view of another embodiment of the invention.
Figure 7:
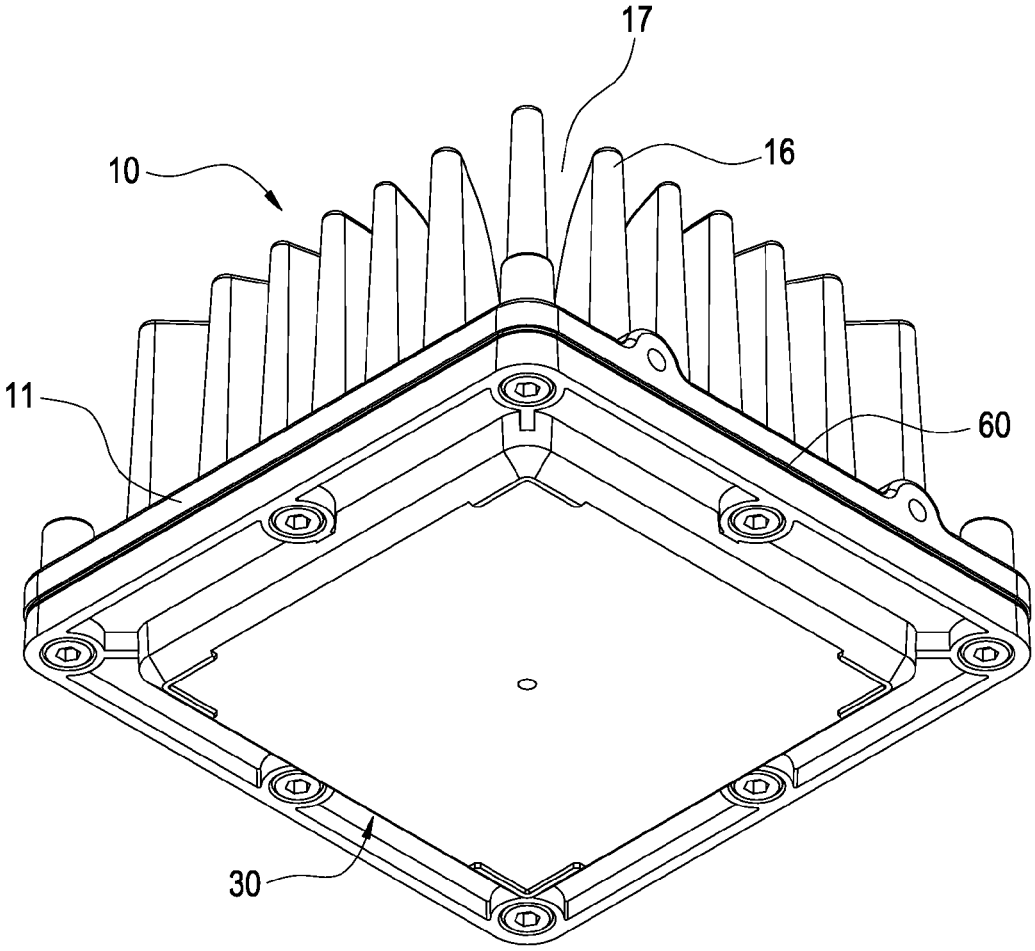
FIG. 7 is an assembled view of the another embodiment of the invention.
Figure 8:
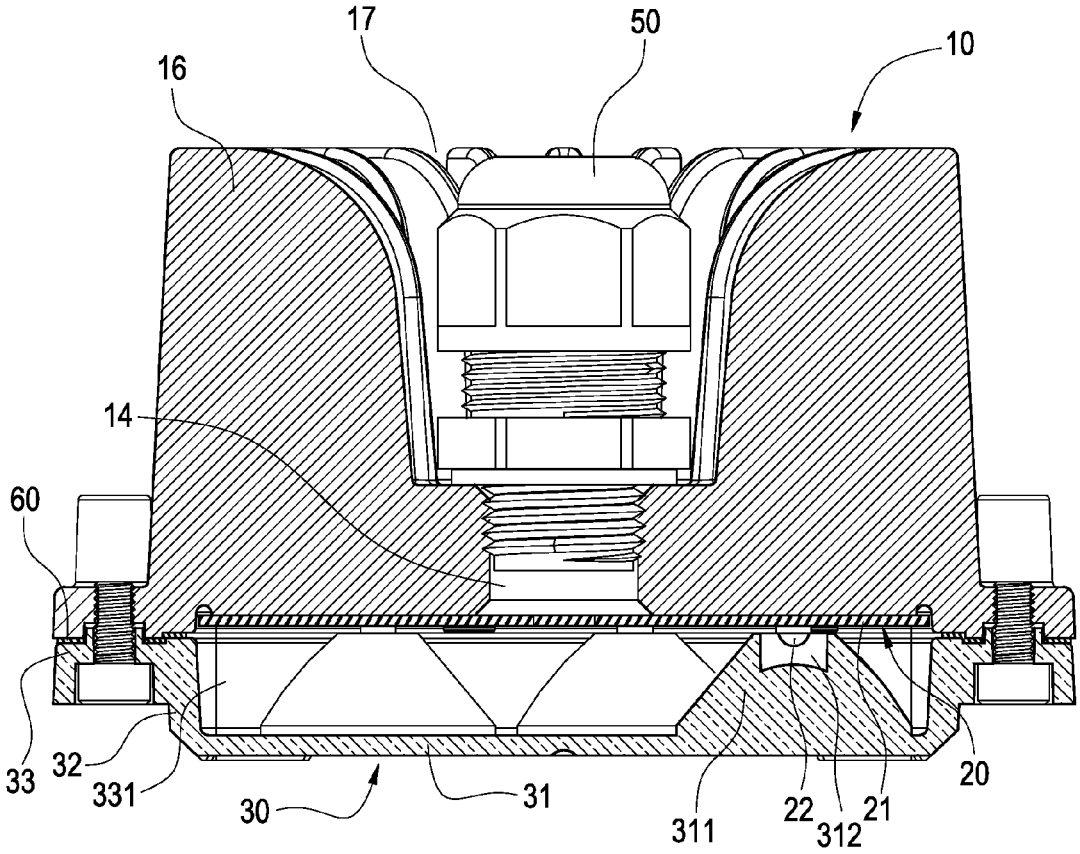
FIG. 8 is a cross-sectional view of the another embodiment of the invention.

Please refer to FIGS. 6-8, which show another preferred embodiment of the invention. In this embodiment, the through hole 14 is located at the center of the mount board 11 and the fins 16 are centrally radially arranged about the through hole 14. An annular rib 122 is formed on the first surface 12. The flange 33 of the hood 30 is provided with a groove 331 corresponding to the annular rib 122. This embodiment replaces the sealant 40 with a water resistant washer 60 which is sandwiched between the flange 33 and the first surface 12. The water resistant washer 60 is pressed by the annular rib 122 to be embedded into the groove 331 for sealing up. Thus, water resistance can be obtained. Further, each of the protrusions 311 is of a bowl shape. The protrusion 311 has an upper recess 312 for accommodating the LED 22 and the bottom of the protrusion 311 is a flat plane so that the protrusion 311 still functions as a concave lens.

Figure 9:
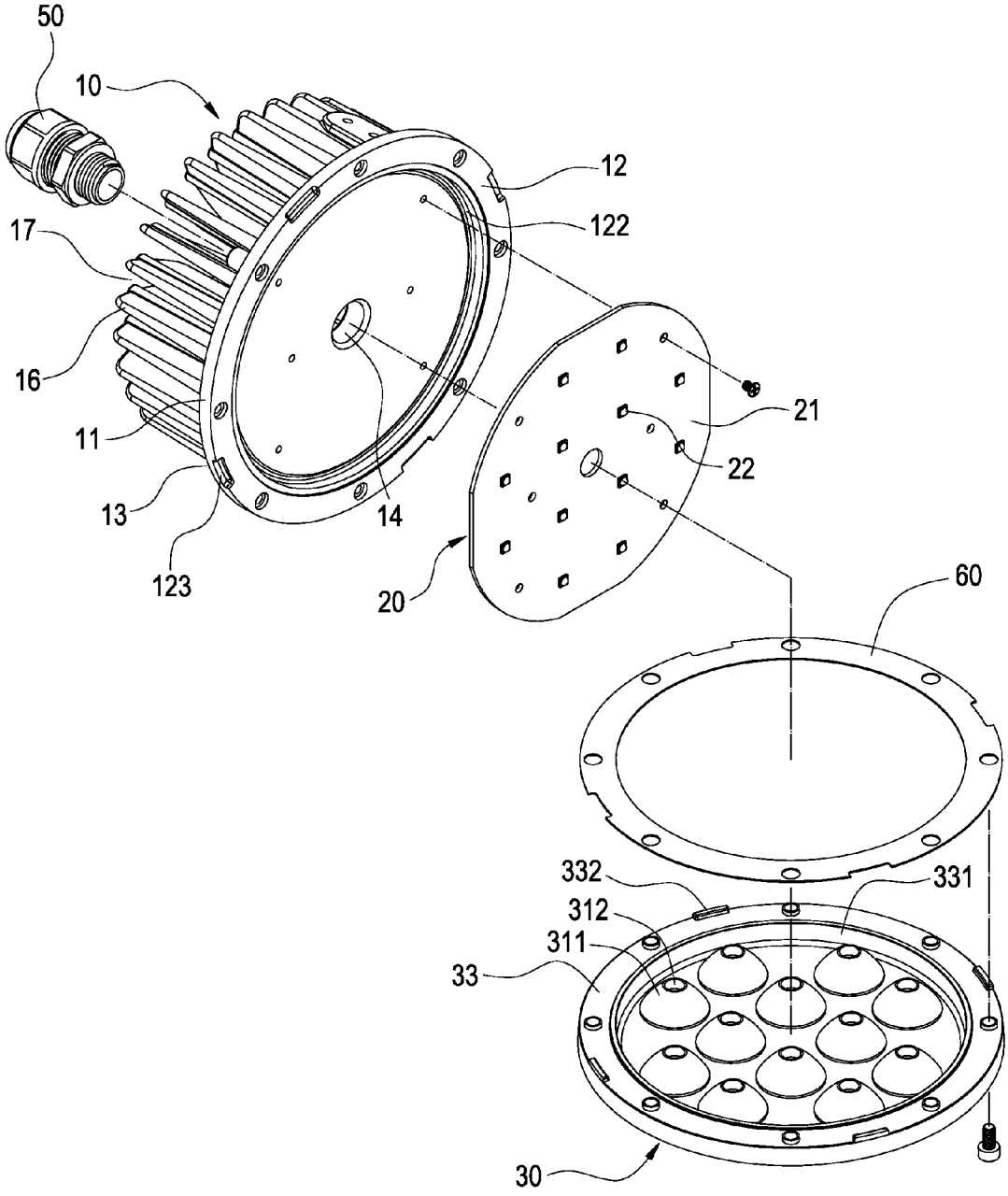
FIG. 9 is an exploded view of still another embodiment of the invention.
Figure 10:
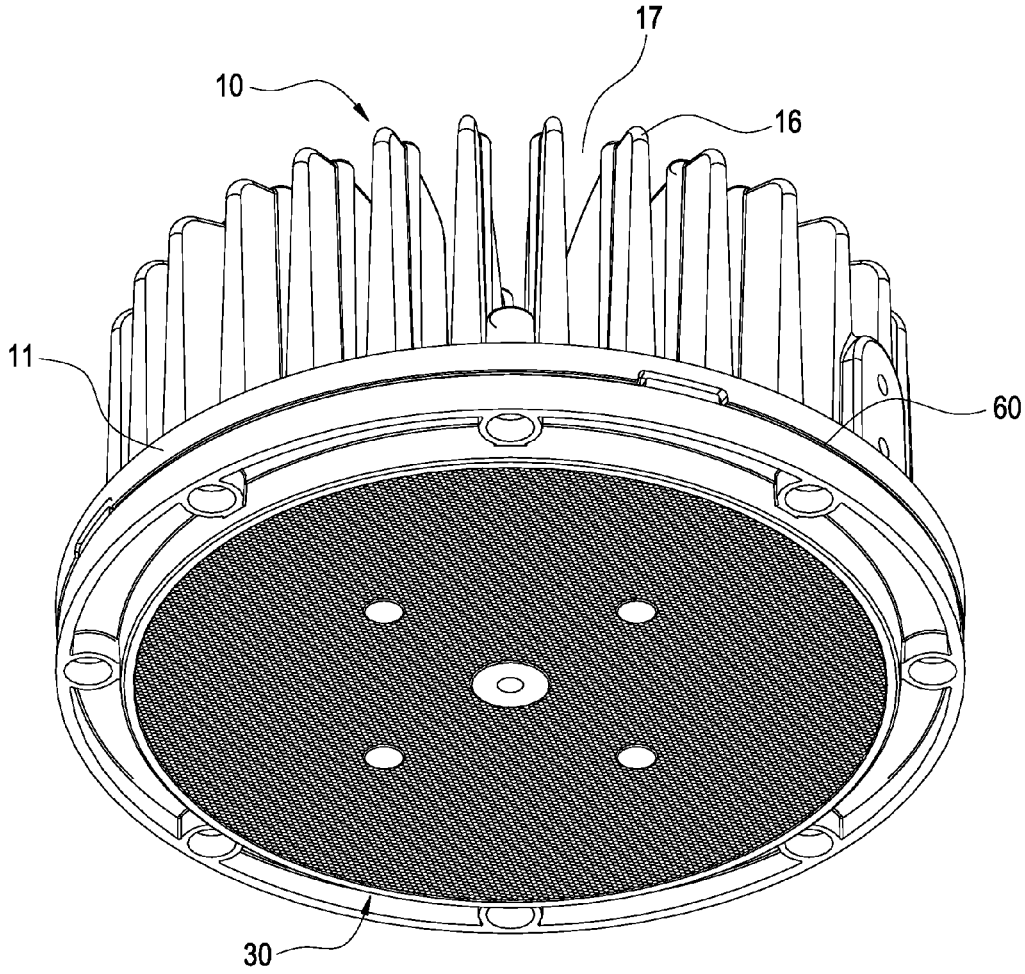
FIG. 10 is an assembled view of the still another embodiment of the invention.

Please refer to FIGS. 9-10, which show still another embodiment of the invention. In this embodiment, the LED lamp is of a substantially cylindrical shape. The first surface 12 is provided with positioning cavities 123 and the flange 33 is provided with projections 332 corresponding to the positioning cavities 123. The projections 332 can be separately embedded into the cavities 123 for alignment.

It will be appreciated by persons skilled in the art that the above embodiments have been described by way of example only and not in any limitative sense, and that various alterations and modifications are possible without departure from the scope of the invention as defined by the appended claims.

What is claimed is:

1. A light emitting diode (LED) lamp comprising:

a heat dissipating base, having a mount board, the mount board including a first surface and a second surface, the first surface being formed with an annular trough, and the second surface being provided with fins;

an LED module fixed on the mount board and surrounded by the annular trough;

a hood, having a flange and cloaking the LED module by embedding the flange into the annular trough; and a sealant filled in the annular trough to seal up the flange.

2. The LED lamp of claim 1, wherein the LED module includes a circuit board fixed on the mount board and LEDs mounted on the circuit board, and the LEDs abut against the mount board with a thermal contact.

3. The LED lamp of claim 2, wherein the hood has a bottom, a surrounding wall extending from the bottom and a flange outwards extending from the surrounding wall.

4. The LED lamp of claim 3, wherein a plurality of protrusions which are corresponding to the LEDs are formed on an inner side of the bottom, each of the protrusions is formed with an upper recess accommodating one of the LEDs and a lower recess for making the protrusion function as a concave lens.

5. The LED lamp of claim 1, wherein an air passage is formed between every two adjacent fins, and a spacing gap communicating with any adjacent two of the spacing gap is formed in the fins.

6. The LED lamp of claim 1, further comprising a water resistance connector screwed in a through hole in the mount board.

* * * * *